US006497186B1

(12) United States Patent
Lundblad

(10) Patent No.: US 6,497,186 B1
(45) Date of Patent: Dec. 24, 2002

(54) SAFE FOR VALUABLE DOCUMENTS SUCH AS BANKNOTES, CHEQUES ETC.

(75) Inventor: Leif Lundblad, Stockholm (SE)

(73) Assignee: Nybohov Development AB, Stockholm (SE)

( * ) Notice: Subject to any disclaimer, the term of this patent is extended or adjusted under 35 U.S.C. 154(b) by 0 days.

(21) Appl. No.: 09/856,464

(22) PCT Filed: Dec. 9, 1999

(86) PCT No.: PCT/SE99/02304

§ 371 (c)(1),
(2), (4) Date: Jun. 7, 2001

(87) PCT Pub. No.: WO00/39424

PCT Pub. Date: Jul. 6, 2000

(30) Foreign Application Priority Data

Dec. 23, 1996 (SE) ..... 9804534

(51) Int. Cl.[7] ..... E05G 1/12

(52) U.S. Cl. ..... 109/25; 109/29; 109/30; 109/31; 109/32; 109/33; 109/34; 109/36; 109/37

(58) Field of Search ..... 109/25, 29, 30, 109/31, 32, 33, 34, 36, 37; 285/382

(56) References Cited

U.S. PATENT DOCUMENTS

| | | | | | |
|---|---|---|---|---|---|
| 2,981,492 | A | | 4/1961 | Simjian | 242/67.3 |
| 3,222,057 | A | * | 12/1965 | Couri | 192/40 |
| 3,683,943 | A | * | 8/1972 | De Crepy | 194/206 |
| 4,337,864 | A | * | 7/1982 | McLean | 209/534 |
| 4,513,880 | A | * | 4/1985 | Mori et al. | 221/260 |
| 4,712,489 | A | | 12/1987 | Levavasseur | 109/25 |
| 5,156,272 | A | * | 10/1992 | Bouchard et al. | 109/25 |
| 5,406,896 | A | | 4/1995 | Jacobson | 109/29 |
| 5,537,938 | A | * | 7/1996 | Lopez, Jr. | 109/25 |
| 5,775,235 | A | * | 7/1998 | Lindskog et al. | 109/25 |
| 5,787,819 | A | * | 8/1998 | Fumanelli | 109/25 |
| 6,259,366 | B1 | * | 7/2001 | Lindskog et al. | 109/25 |

FOREIGN PATENT DOCUMENTS

| | | | |
|---|---|---|---|
| GB | 1446711 | * | 8/1973 |
| GB | 2 199 890 | | 7/1988 |
| SE | 508 554 | | 10/1998 |

* cited by examiner

*Primary Examiner*—Anthony Knight
*Assistant Examiner*—Christopher Boswell
(74) *Attorney, Agent, or Firm*—Jacobson Holman PLLC

(57) ABSTRACT

A safe for accomodating valuable documents includes one or more units (1–17), each of which is intended to accomodate several valuable documents and is equipped with destructive devices (112–172) for local destruction of valuable documents in respective units when an attempt to break into the safe (1) is made. Each of the destruction devices (e.g. 112) includes at least one container (31) disposed adjacent a valuable document wind-up drum (30). The container includes a peripheral, circular continuous recess or channel (311) intended for destructive material (33) and facing towards the exposed edges of valuable documents. The opening (3111, 3211) of the recess or channel (311, 321) is covered with a ring-shaped plastic or steel net. The recess contains dye capsules (33) and a ring-shaped fuse (3113, 3213) for activation of the dye when an attempt to break into the safe (1) is made.

4 Claims, 3 Drawing Sheets

Fig 2
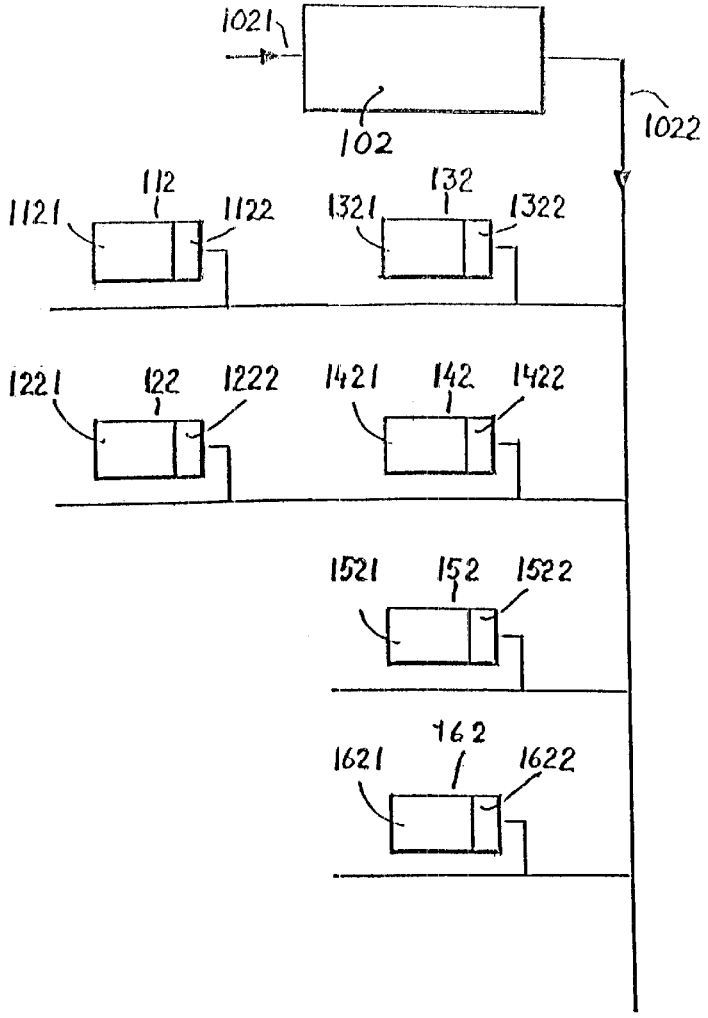
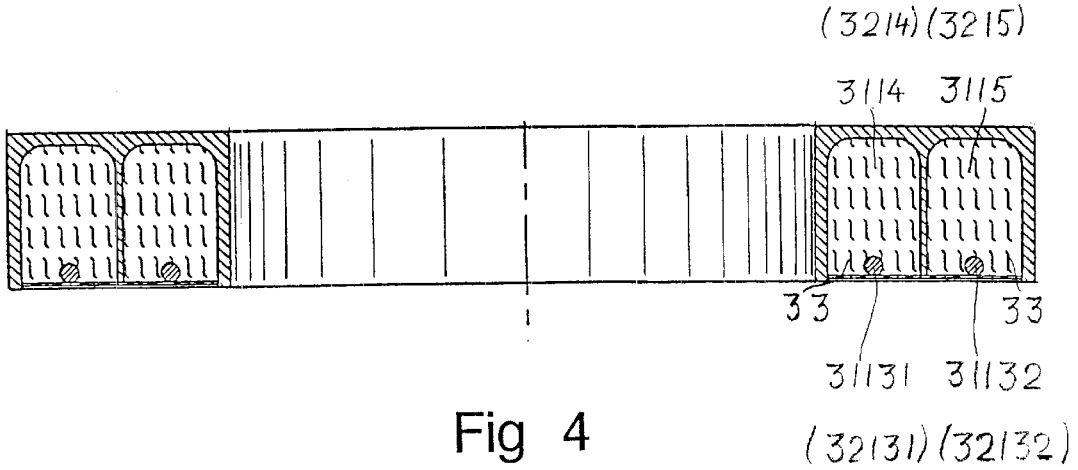
Fig 4

SAFE FOR VALUABLE DOCUMENTS SUCH AS BANKNOTES, CHEQUES ETC.

FIELD OF INVENTION

The present invention relates to safes for the safekeeping of valuable documents, such as banknotes, cheques, etc., and more specifically to safes that include one or more units that are each intended for a plurality of valuable documents and equipped with destructive means for local destruction of valuable documents in respective units when an attempt to break into the safe is made.

SUMMARY OF THE INVENTION

In safes of the aforedescribed kind and constructed in accordance with the invention, each of the destructive devices includes at least one container which is mounted adjacent a winding-up drum that is intended for winding-up valuable documents and which has extending peripherally in its longitudinal direction a circular, continuous recess or channel which faces towards the exposed edges of the valuable documents and which is intended to accommodate destructive material.

These and other characteristic features of an inventive safe will be apparent from the accompanying Claims.

BRIEF DESCRIPTION OF THE DRAWINGS

The invention will now be described in more detail with reference to the accompanying schematic drawings, in which

FIG. 2 is a diagrammatic illustration of destructive devices included in the safe according to FIG. 1;

FIG. 4 illustrates a modification of the destructive device according to FIG. 3.

DETAILED DESCRIPTION OF PREFERRED EMBODIMENTS

Figure 1:
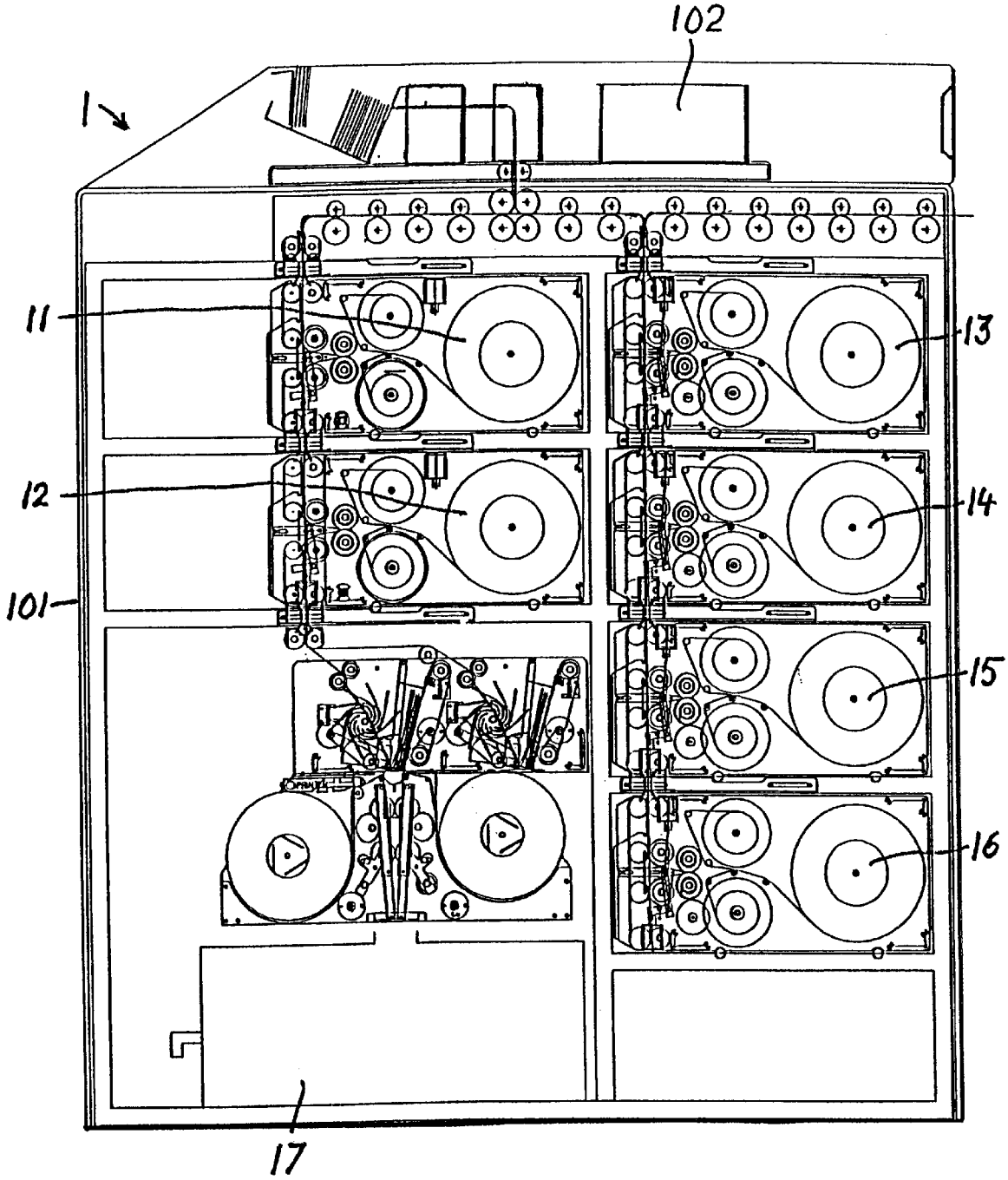
FIG. 1 illustrates an inventive safe.

The safe 1 illustrated in FIG. 1 is intended for the safekeeping of valuable documents, such as banknotes, cheques, etc., and includes a plurality of units 11–17 which are each intended to accommodate a plurality of valuable documents. The safe as a whole is fitted with a so-called shell or outer casing protection means 101 which functions to disclose/indicate when an attempt is made to break into the safe.

The majority of the aforesaid units each includes a destructive device 112–162 (see FIG. 2) that has an explosive or some other activating means, and a dyestuff or some other destructive substance (such as glue) for local destruction of valuable documents contained in respective units 11, 12, . . . 16.

These destructive elements are activated from a processor unit 102, depending on whether or not respective units contain valuable documents at that moment or are empty.

FIG. 2 is a diagrammatic illustration illustrating the destructive devices 112–162, each of said devices comprising a dye-containing part 1121–1621 and an explosive part 1122–1622. Extending from the processor unit 102 controlling the destructive devices is a multi-conductor cable 1022 through which ignition impulses are set to respective explosive parts in response to damage to the shell protection means 101 and also depending on whether respective units 11–16 contain banknotes or are empty. Information relating to presence of valuable documents in said units is delivered continuously to an input 1021 on the processor unit 102.

Figure 3:
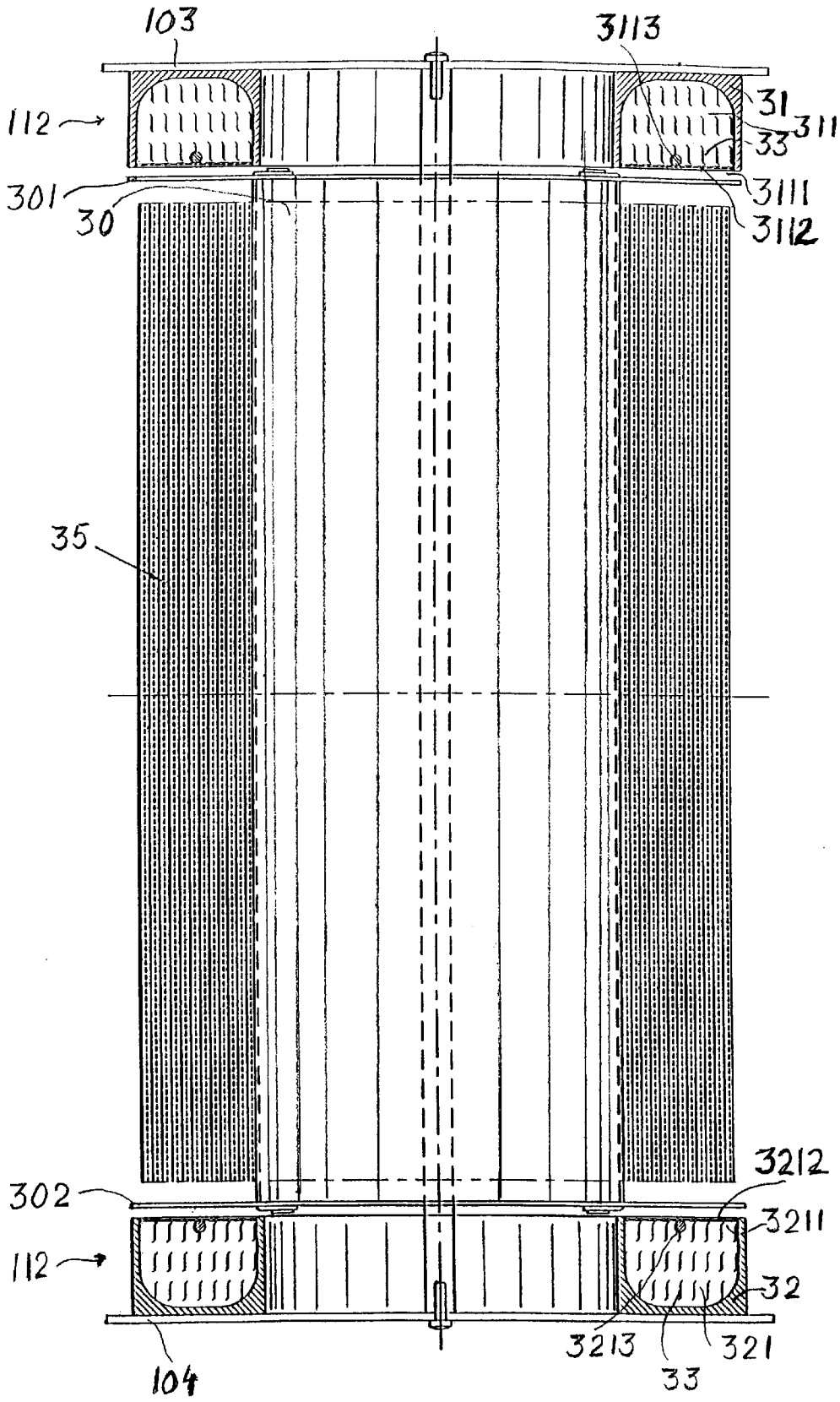
FIG. 3 illustrates one of a number of destructive devices included in the safe according to FIG. 1.

FIG. 3 illustrates a destructive device 112 which comprises two device parts in the form of container means 31, 32, disposed on two mutually opposite sides of a drum 30 onto which valuable documents are wound. Each container means 31, 32 includes a peripheral continuous recess or channel 311, 321 which accommodates destructive material 33 and is circular in its longitudinal direction and faces towards the exposed edges of the valuable documents. The valuable documents 35, e.g. banknotes, are encased and wound up between plastic belts. Fixedly mounted on respective ends of the drum are end-walls 301, 302 which are provided with a plurality of holes in a peripheral ring corresponding to the openings of the recesses or channels 311, 321.

As banknotes are fed in or out, the drum 30 rotates with its end-walls 301, 302, whereas the containers 31, 32 are affixed to walls 103, 104 in the safe 1 and are thus stationary.

The opening 3111 and 3211 of respective recesses or channels 311, 321, facing the edges of the valuable documents, is covered with a ring-shaped net 3112 and 3212 respectively. The recesses include a number of capsules containing a destructive material 33 in the form of a dye, and a ring-shaped detonation fuse 3113 and 3213 respectively for activation of the destructive material in the event of an attempt to break into the safe 1.

FIG. 4 illustrates a further development of the invention in which each recess or channel, e.g. the recess 311, is divided into separate chambers 3114, 3115 each housing a capsule that contains destructive material 33, and also housing a ring-shaped detonation fuse 31131 and 31132 respectively. The recess or channels 321 also has two separate chambers 3214, 3215 containing dye capsules and detonation fuses 32131 and 32132 respectively.

What is claimed is:

1. A safe (1) for the safekeeping of valuable documents such as banknotes and cheques, etc., and including one or more units (11–17) each intended to accommodate a plurality of valuable documents and each being equipped with destructive devices (112–172) for local destruction of valuable documents in respective units when an attempt is made to break into the safe (1), characterised in that each (e.g. 112) of the destruction devices (112–172) includes at least one container (31), which is disposed adjacent to a drum (30) for winding-up of valuable documents, said container being provided with a peripheral, continuous and generally circular recess or channel (311) intended for destructive material (33) and facing towards the exposed edges of valuable documents.

2. A safe according to claim 1, characterised in that each (e.g. 112) of the destructive devices (112–172) includes two containers (31, 32) on mutually opposite sides of the valuable document wind-up drum (30), wherein each of said containers includes a peripheral, circular and continuous recess or channel (311, 321), wherein the continuous recess or channel (311, 321) is open towards exposed edges of the valuable documents.

3. A safe according to claim 2, characterised in that the opening (3111, 3211) of respective recess or channel (3111, 3212) facing exposed edges of said valuable documents is covered with a ring-shaped net structure (3112, 3212); and in that the respective recess or channel (311, 321) includes capsules containing destructive material (33) in the form of dye, and also a ring-shaped detonation fuse (3113, 3213) for activating the destructive material (33) when an attempt to break into the safe (1) is made.

4. A safe according to claim 3, characterised in that said recess or channel (311, 321) is divided into two mutually separate chambers (3114, 3115; 3214, 3214) each of which contains a destructive material container and a detonating fuse (31131, 31132; 32131, 32132) for activation of the destructive material in respective chambers.

* * * * *